US009386383B2

(12) United States Patent
Nielsen et al.

(10) Patent No.: US 9,386,383 B2
(45) **Date of Patent: *Jul. 5, 2016**

(54) HEARING AID RECEIVER AND A HEARING AID COMPRISING SUCH A RECEIVER

(71) Applicant: GN ReSound A/S, Ballerup (DK)

(72) Inventors: Henrik Nielsen, Roskilde (DK); Jan Johansen, Koge (DK)

(73) Assignee: GN ReSound A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/336,471

(22) Filed: Jul. 21, 2014

(65) Prior Publication Data

US 2015/0296315 A1 Oct. 15, 2015

(30) Foreign Application Priority Data

Apr. 10, 2014 (DK) ..... 2014 70200
Apr. 10, 2014 (EP) ..... 14164145

(51) Int. Cl.
*H04R 25/00* (2006.01)

(52) U.S. Cl.
CPC ..... *H04R 25/654* (2013.01); *H04R 25/608* (2013.01); *H04R 25/65* (2013.01); *H04R 2225/025* (2013.01); *H04R 2460/09* (2013.01)

(58) Field of Classification Search
CPC .... H04R 25/60; H04R 25/604; H04R 25/608; H04R 25/65; H04R 25/652; H04R 25/654; H04R 25/656; H04R 25/658; H04R 2225/021; H04R 2225/023; H04R 2225/025; H04R 2460/17; H04R 2460/09
USPC ..... 381/322, 324, 325, 328, 329, 330; 181/129, 130, 135
See application file for complete search history.

(56) References Cited

U.S. PATENT DOCUMENTS

| | | | |
|---|---|---|---|
| 2,950,357 | A | 8/1960 | Mitchell |
| 2,959,645 | A | 11/1960 | Ladd |
| 3,408,461 | A | 10/1968 | Langford |
| 3,852,540 | A | 12/1974 | Diethelm |
| 4,553,627 | A | 11/1985 | Gastmeier et al. |

(Continued)

FOREIGN PATENT DOCUMENTS

| | | | |
|---|---|---|---|
| DE | 3428166 | A1 | 2/1986 |
| DE | 10 2008 055 919 | A1 | 3/2009 |

(Continued)

OTHER PUBLICATIONS

Second Technical Examination dated May 19, 2015, for related Danish Patent Application No. PA 2014 70199, 3 pages.
Second Technical Examination dated May 20, 2015, for corresponding Danish Patent Application No. PA 2014 70200, 3 pages.

(Continued)

*Primary Examiner* — Huyen D Le
(74) *Attorney, Agent, or Firm* — Vista IP Law Group, LLP

(57) ABSTRACT

A receiver for a hearing aid includes: a receiver housing having a side face with a sound opening; and a filter holder with a filter, wherein the filter holder is fastened to the receiver housing; wherein the filter holder has a bottom face, a first opening at the bottom face, a second opening configured for releasably mounting the filter to the filter holder, and a sound channel located between the first and second openings and aligned with the first opening; and wherein the bottom face of the filter holder abuts the side face of the receiver housing.

11 Claims, 3 Drawing Sheets

(56) References Cited

U.S. PATENT DOCUMENTS

| | | | | | |
|---|---|---|---|---|---|
| 4,679,650 | A | | 7/1987 | Moser et al. | |
| 4,937,876 | A | | 6/1990 | Biermans | |
| 4,972,488 | A | * | 11/1990 | Weiss | H04R 25/654 381/322 |
| 5,099,947 | A | | 3/1992 | Guggenberger et al. | |
| 5,278,360 | A | * | 1/1994 | Carbe | H04R 25/654 181/135 |
| 5,970,157 | A | * | 10/1999 | Yoest | H04R 25/654 381/324 |
| 6,129,174 | A | | 10/2000 | Brown et al. | |
| 6,205,227 | B1 | | 3/2001 | Mahoney et al. | |
| 6,389,143 | B1 | | 5/2002 | Leedom et al. | |
| 6,434,248 | B1 | | 8/2002 | Juneau et al. | |
| 8,098,866 | B2 | | 1/2012 | Gommel et al. | |
| 2002/0027996 | A1 | | 3/2002 | Leedom et al. | |
| 2002/0198437 | A1 | | 12/2002 | Juneau et al. | |
| 2003/0198361 | A1 | | 10/2003 | Heerlein et al. | |
| 2006/0153418 | A1 | | 7/2006 | Van Halteren | |
| 2009/0041261 | A1 | | 2/2009 | Fickweiler et al. | |
| 2009/0046880 | A1 | | 2/2009 | Gunnersen et al. | |
| 2010/0220884 | A1 | | 9/2010 | Aquilina et al. | |
| 2011/0013797 | A1 | | 1/2011 | Cheng et al. | |
| 2012/0163643 | A1 | | 6/2012 | Vestergaard et al. | |

FOREIGN PATENT DOCUMENTS

| | | | |
|---|---|---|---|
| DE | 10 2010 041 695 | A1 | 8/2011 |
| EP | 2 663 097 | A1 | 11/2013 |
| WO | WO 2010147554 | A1 | 12/2010 |
| WO | WO 2012006383 | A1 | 1/2012 |
| WO | WO 2013091682 | A1 | 6/2013 |

OTHER PUBLICATIONS

An extended European Search Report dated Sep. 18, 2014, issued in the European Patent Application No. 14164146.4-1901, Applicant: GN ReSound A/S, Reference No. P1750EP00 (6pages).

An Office Communication dated Oct. 30, 2014, issued in the Danish Patent Application No. PA 2014 70201, Applicant: GN ReSound A/S, Reference No. P1750DK00 (7pages).

An Office Communication dated Oct. 21, 2014, issued in the Danish Patent Application No. PA 2014 70199, Applicant: GN ReSound A/S, Reference No. P1596DK00 (6pages).

An Office Communication dated Oct. 24, 2014, issued in the Danish Patent Application No. PA 2014 70200, Applicant: GN ReSound A/S, Reference No. P1597DK00 (6pages).

An Office Communication dated Oct. 31, 2014, issued in the Danish Patent Application No. PA 2014 70202, Applicant: GN ReSound A/S, Reference No. P1751DK00 (7pages).

Non-final Office Action dated Aug. 26, 2015 for related U.S. Appl. No. 14/336,863.

Non-final Office Action dated Oct. 2, 2015 for related U.S. Appl. No. 14/331,918.

Non-final Office Action dated Oct. 5, 2015 for rleated U.S. Appl. No. 14/333,397.

Second Technical Examination dated Sep. 16, 2015 for related Danish Patent Application No. PA 2014 70201.

Second Technical Examination dated Sep. 21, 2015 for related Danish Patent Application No. PA 2014 70202.

Notice of Allowance and Fee(s) Due dated Mar. 9, 2016 for related U.S. Appl. No. 14/336,863.

Notice of Allowance and Fee(s) Due dated Mar. 28, 2016 for related U.S. Appl. No. 14/333,397.

* cited by examiner

HEARING AID RECEIVER AND A HEARING AID COMPRISING SUCH A RECEIVER

RELATED APPLICATION DATA

This application claims priority to, and the benefit of, Danish Patent Application No. 2014 70200, filed on Apr. 10, 2014, pending, and European Patent Application No. 14164145.6, filed on Apr. 10, 2014, pending. The entire disclosures of the above applications are expressly incorporated by reference herein.

FIELD

The present disclosure relates to a receiver/loudspeaker adapted for being mounted in a hearing aid, and comprising a receiver housing having a first substantially plane side face with a sound opening, and a filter holder with a filter, such as a cerumen filter, and where the filter holder comprises a substantially plane bottom face and a sound channel extending between a first opening arranged in the substantially plane bottom face, and a second opening adapted for releasably mounting of the filter in the filter holder in the sound channel.

The present disclosure also relates to a hearing aid comprising such a receiver.

BACKGROUND

Hearing aids of the above mentioned kind are known in a lot of different embodiments, where the filter is mostly used as a wax guard with the primary purpose of avoiding ear wax from migrating into the receiver.

Especially in relation to ITE "In The Ear" hearing aids there is an ongoing re-search and development with respect to provide ITE hearing aids with optimal sound quality and performance on the one hand, and on the other hand providing a hearing aid being as discrete as possible in the ear of the user. This requires that the components of the hearing aid, such as e.g. the receiver, the filter and its socket, and the electronics used for providing the audible signal are to be arranged in ever smaller spaces, and at the same time providing good sound quality.

SUMMARY

One object is to provide a hearing aid where especially the receiver and the filter socket requires reduced volume in a hearing aid.

This is obtained with the hearing aid mentioned in the introduction, and where the filter holder is fastened to the receiver housing, so that the substantially plane bottom plate of the filter holder abuts the substantially plane side face of the receiver housing, and so that the sound opening is aligned with the first opening. Thereby the sound channel between the filter and the receiver is kept very short, so that the required length of the hearing aid is reduced.

In a preferred embodiment the substantially plane bottom plate is fastened to the first substantially plane side face of the receiver housing.

Furthermore the filter holder may preferably be fastened to the receiver housing by gluing, soldering or welding.

The receiver housing may in a preferred embodiment extend within a substantially uniform rectangular cross section in all planes parallel to the first substantially plane side face, and the filter holder may have a cylindrical outer surface defining an outer diameter, and where the diagonal dimension of the substantially uniform cross section of the receiver housing is smaller than the outer diameter of the filter holder.

In a further preferred embodiment the filter holder defines a direction of detachment of the filter from the filter socket, and the receiver/loudspeaker defines a primary direction of sound outlet being perpendicular to the substantially plane side face, and wherein the direction of detachment is arranged obliquely with respect to the primary direction of sound outlet, so that the receiver/loudspeaker is easy to build into a number of different hearing aids.

In a preferred embodiment the angle between the direction of detachment and the primary direction of sound is within the range from 5° to 45° and preferably in the range from 10° to 30°.

A hearing aid according to some embodiments comprises a hearing aid housing with a receiver as mentioned above. The hearing aid housing comprises an outer surface and an internal cavity adapted for containing the receiver and the hearing aid housing comprises a filter socket wherein the filter holder is releasably mounted, so that the filter holder provides a sound channel extending through the filter between the outer surface and the receiver housing.

In a preferred embodiment of the hearing aid, the filter socket and the receiver are relatively sized in order to allow for insertion of the receiver housing through the channel and into the internal cavity, when the filter is dismantled from the filter socket.

In this relation the filter holder may in one preferred embodiment be permanently fastened to the receiver housing by gluing, soldering or welding.

In an alternative embodiment the filter holder may be releasably attached to the receiver housing with a press fit, a frictional fit, or by means of heat releasable glue.

A receiver for a hearing aid includes: a receiver housing having a side face with a sound opening; and a filter holder with a filter, wherein the filter holder is fastened to the receiver housing; wherein the filter holder has a bottom face, a first opening at the bottom face, a second opening configured for releasably mounting the filter to the filter holder, and a sound channel located between the first and second openings and aligned with the first opening; and wherein the bottom face of the filter holder abuts the side face of the receiver housing.

Optionally, the bottom plate is fastened to the side face of the receiver housing.

Optionally, the filter holder is fastened to the receiver housing by gluing, soldering or welding.

Optionally, the receiver housing has a cross section defined at least partially by first two sides that are parallel to each other and second two sides that are perpendicular to the first two sides; wherein the filter holder has an outer surface conforming to the receiver housing and defining an outer opening; and wherein a largest cross sectional dimension of the receiver housing is smaller than the outer opening of the filter holder.

Optionally, the filter holder defines a direction of detachment of the filter from the filter holder, the sound opening at the side face defines a primary direction of a sound emission that is perpendicular to the side face, and the direction of detachment is oblique with respect to the primary direction of the sound outlet.

Optionally, an angle between the direction of detachment and the primary direction of the sound emission is anywhere from 5° to 45°.

Optionally, the filter holder is permanently fastened to the receiver housing by gluing, soldering or welding.

Optionally, the filter holder is releasably attached to the receiver housing with a press fit, a frictional fit, or a heat releasable glue.

Optionally, the filter comprises a cerumen filter.

A hearing aid includes: a hearing aid housing; and the receiver; wherein the hearing aid housing comprises an internal cavity configured for containing the receiver.

Optionally, the hearing aid housing further comprises an outer surface and a housing opening at the outer surface, and wherein the housing opening and the receiver are relatively sized in order to allow for insertion of the receiver through the housing opening into the internal cavity of the hearing aid housing.

Other and further aspects and features will be evident from reading the following detailed description of the embodiments.

BRIEF DESCRIPTION OF THE DRAWINGS

In the following, the embodiments will be described in greater detail with reference to the enclosed figures. It should be emphasized that the embodiments shown are used for example purposes only and should not be used to limit the scope of the claimed invention.

DETAILED DESCRIPTION OF THE EMBODIMENTS

It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Figure 1:
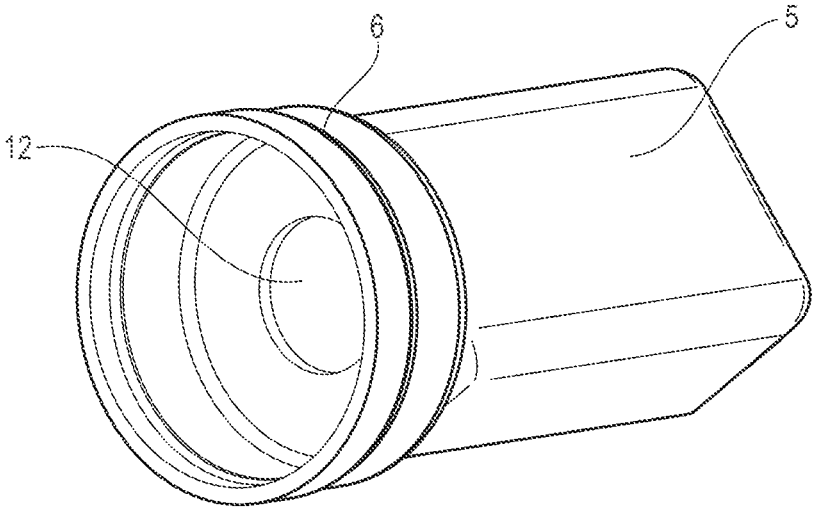
FIG. 1: Is a perspective view of a receiver according to some embodiments.
Figure 2:
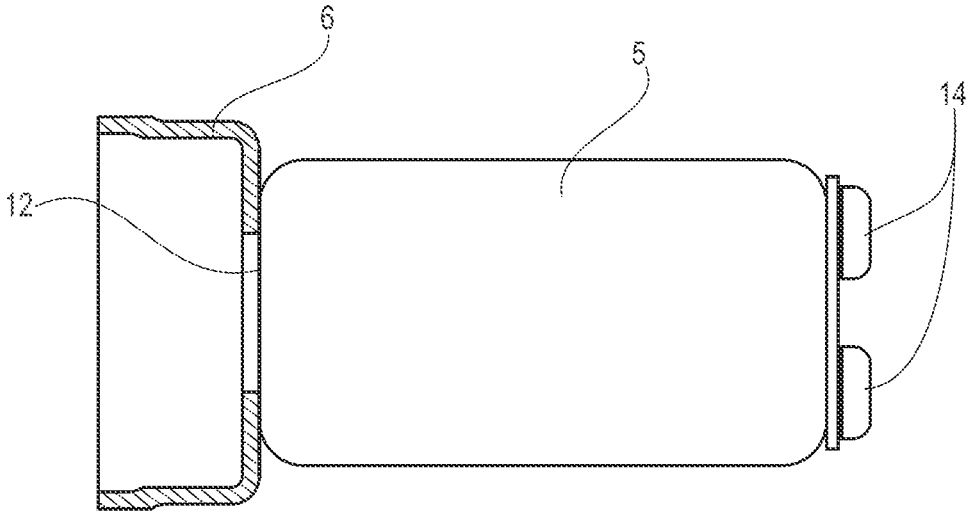
FIG. 2: is a side view of the receiver shown in FIG. 1.

FIGS. 1 and 2 shows a perspective view and a side view of one embodiment of a receiver. The receiver comprises a receiver housing 5 integral with a filter holder 6 fixed to a side face 12 of the receiver housing 5.

Figure 3:
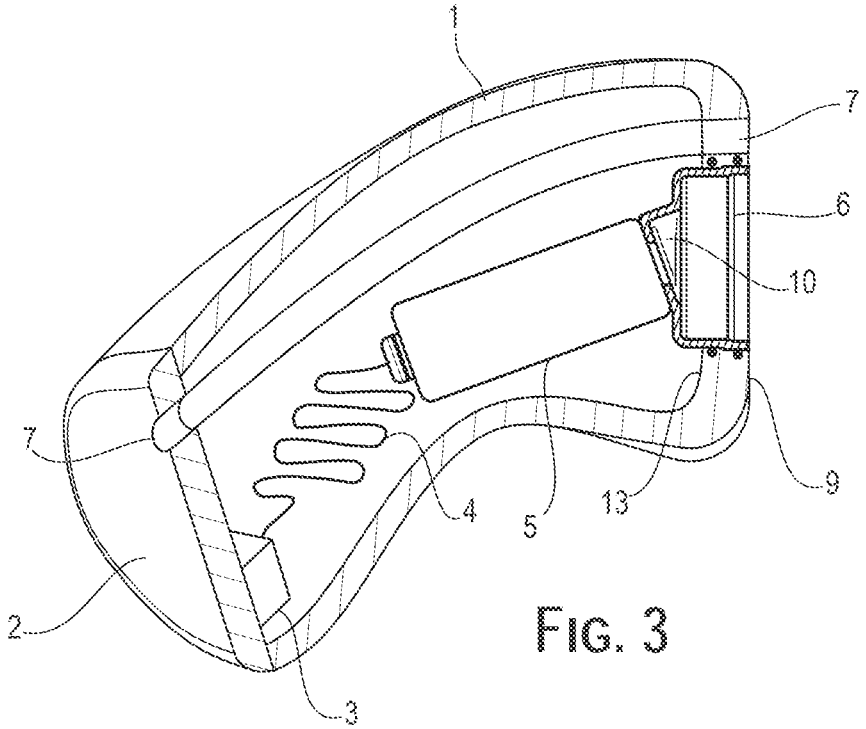
FIG. 3: Is a principle drawing showing a cross section of a hearing aid according to some embodiments.
Figure 6:
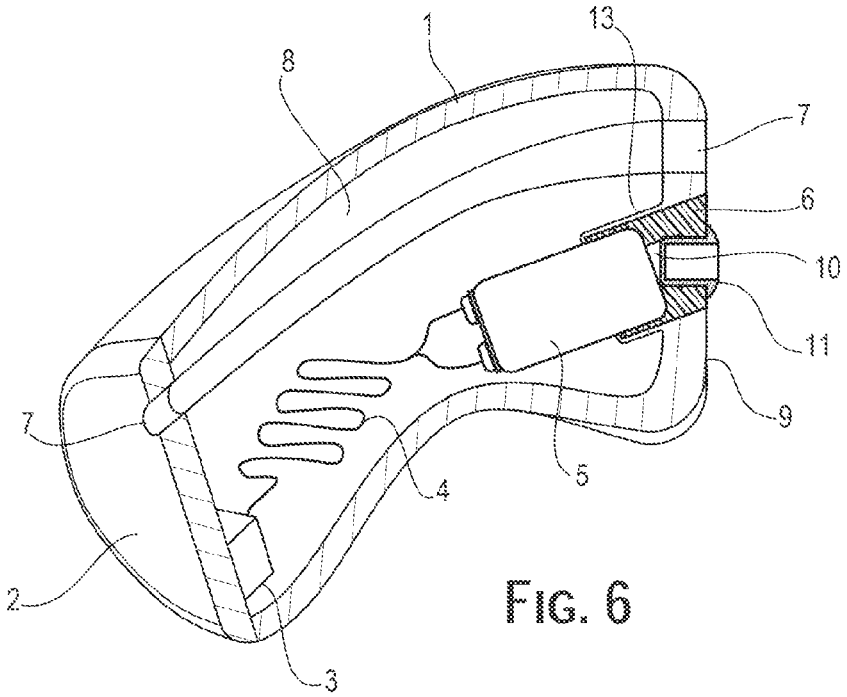
FIG. 6: Is a principle drawing showing a cross section of another embodiment of a hearing aid.

FIGS. 3 and 6 are principle drawings showing a cross section through hearing aids according to different embodiments. These hearing aids are both of the ITE (in the ear) type being adapted for being positioned completely in the ear of the user, but it will be apparent to the skilled person that one or more features described herein will also be applicable to other types of hearing aids being only partly positioned in the ear of the user.

The hearing aids shown in FIGS. 3 and 6 has a hearing aid housing 1 being closed at one end by a face plate 2, which will normally be the only visible part of the hearing aid, when the hearing aid is positioned in the ear of a user. Thereby the hearing aid housing 1 and the face plate 2 encloses an internal cavity 8.

In hearing aids of the ITE type all functional devices, such as electronics 3, batteries (not shown), wiring 4, a microphone (not shown), a receiver housing 5 and a cerumen filter holder 6 necessary for the function of the hearing aid have to be positioned in the narrow space provided by the internal cavity 8 in the hearing aid housing 1, and therefore it is important to have a high degree of freedom with respect to positioning each device in an optimal position in order to optimally utilize the space in the hearing aid housing 1.

As it is apparent to the skilled person what functional devices are necessary or nice to have in an ITE hearing aid, then only the electronics 3, the wiring 4, the cerumen filter holder 6 and the receiver housing 5 are shown in FIG. 3 and FIG. 6. Furthermore FIG. 3 shows the filter holder without a filter unit mounted therein, whereas FIG. 6 shows that a filter unit 11 is mounted in the filter holder 6.

Normally the hearing aid housing 1 further comprises e.g. a pressure equalizing channel 7 extending from the internal cavity 8 and to the outer surface 9 on the hearing aid housing 1. This pressure equalizing channel 7 must be arranged so that it is able to equalize pressure differences between the faceplate 2 at the outside of the hearing aid and the closed space in the ear of the user carrying the hearing aid, and thereby further reducing the freedom to position the functional devices in the internal cavity 8 of the hearing aid housing 1.

In the hearing aid housing 1 a cerumen filter socket 13 is arranged in the end of the hearing aid housing facing the inside of the ear of the user, and the filter holder 6 is mounted in the filter socket 13, having a sound channel 10 extending between the filter holder 6 and the receiver housing 5.

The filter holder 6 shown in FIGS. 1, 2, 3, 4 and 5 is made from by deep drawing a sheet of metal to the shape shown in the figures, and is thereafter fixed to the plane side face 12 of the receiver housing 5 by welding, gluing or soldering. In the embodiment shown in FIGS. 6, 7 and 8 the filter holder 6 is as an alternative made from a plastic material, e.g. by injection moulding, and the filter holder 6 is thereafter mounted on the receiver housing 5 by means of a friction fit, a snap fit or by gluing.

Thereby the receiver housing 5 and the filter holder 6 forms a sturdy connection allowing the receiver housing 5 to be suspended only by the filter holder 6.

Figure 4:
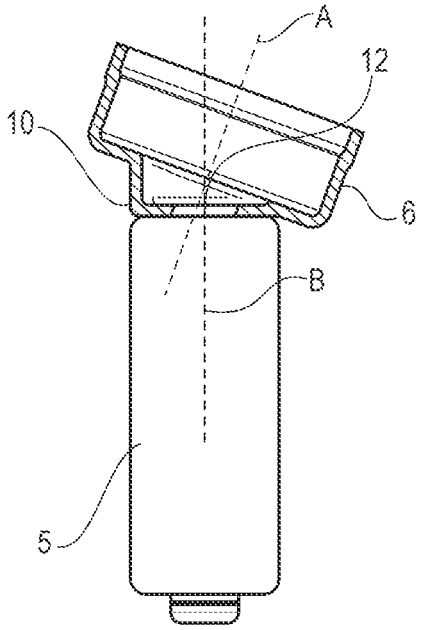
FIG. 4: Shows the receiver assembly shown in FIG. 3.
Figure 5:
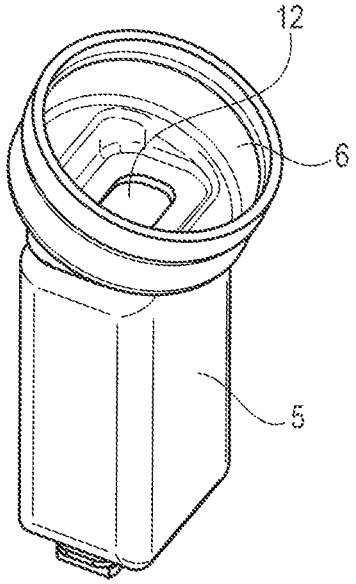
FIG. 5: Is a perspective view of the receiver assembly shown in FIGS. 3 and 4.
Figure 7:
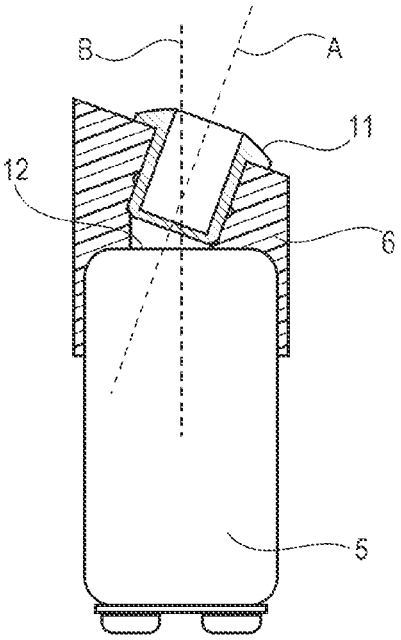
FIG. 7: Shows the receiver assembly shown in FIG. 6.
Figure 8:
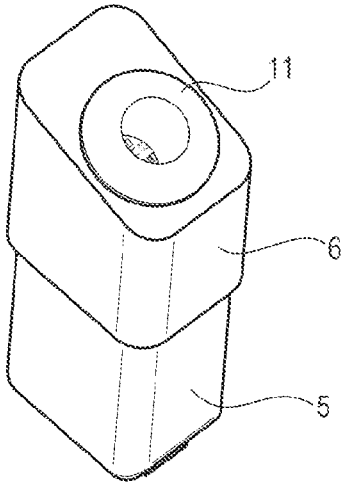
FIG. 8 Is a perspective view of the receiver assembly shown in FIGS. 6 and 7.

According to the shown embodiments, the filter socket 6 is adapted for insertion and detachment of a filter unit 11, such as a cerumen filter, and so that the filter unit 11 can be inserted or detached in a direction of detachment as shown by the dotted line A in FIGS. 4 and 7, and the receiver housing 5 has a plane side face 12 with a sound exit opening defining a primary direction of the sound outlet from the receiver housing 5 being perpendicular to the plane side face 12 as shown by the dotted line B in FIGS. 2 and 5.

In order to provide the best options for positioning the filter/receiver assembly in the hearing aid housing 1, so that the receiver housing 5 requires as little space as possible in the internal cavity 8, then the filter holder 6, the sound channel 10, and the receiver housing 5 are designed so that the direction A of detachment is arranged obliquely to the primary direction B of the sound outlet.

It will, however, be apparent to the skilled person that for many applications the embodiment of the receiver shown in FIGS. 1 and 2, where the filter holder 6 is arranged such that the primary direction of detachment is perpendicular to the sound outlet on the side face 12 of the receiver housing 5, will be the most compact one.

The filter/filter holder 6 is mounted in the filter socket 13 in the hearing aid housing 1, and the filter socket 13 provides a channel to the internal cavity 8 from the outside of the hearing aid housing 1. According to some embodiments, this passage is made sufficiently large to allow for insertion of the receiver into the internal cavity 8 through the channel.

Furthermore the disclosed embodiments of a hearing aid show that the receiver housing 5 is mounted on the filter holder 6 which is mounted in the filter socket 13. As shown in the figures this provides the option of having the receiver 5 suspended only by the filter holder 6, so that it does not touch any parts of the hearing aid housing 1.

The following items are in accordance with one or more embodiments described herein:

Item 1. A receiver adapted for being mounted in a hearing aid, the receiver comprising a receiver housing having a first substantially plane side face with a sound opening and a filter holder with a filter, such as a cerumen filter, the filter holder comprising a substantially plane bottom face and a sound channel extending between a first opening arranged in the substantially plane bottom face, and a second opening adapted for releasably mounting of the filter in the filter holder in the sound channel, wherein the filter holder is fastened to the receiver housing in such a way that the substantially plane bottom plate of the filter holder abuts the substantially plane side face of the receiver housing and the sound channel is aligned with the first opening.

Item 2. A receiver according to item 1, where the substantially plane bottom plate is fastened to the first substantially plane side face of the receiver housing.

Item 3. A receiver according to item 2, where the filter holder is fastened to the receiver housing by gluing, soldering or welding.

Item 4. A receiver according to item 1, wherein the receiver housing extends within a substantially uniform rectangular cross section in all planes parallel to the first substantially plane side face, the filter holder has an outer surface conforming to the receiver housing and defining an outer opening, and the diagonal dimension of the substantially uniform cross section of the receiver housing is smaller than the outer opening of the filter holder.

Item 5. A receiver according to one or more of the preceding items, wherein the filter holder defines a direction of detachment of the filter from the filter socket, the receiver defines a primary direction of a sound outlet being perpendicular to the substantially plane side face, and wherein the direction of detachment is arranged obliquely with respect to the primary direction of the sound outlet.

Item 6. A receiver according to item 5, wherein the angle between the direction of detachment and the primary direction of sound is within the range from 5° to 45° and preferably in the range from 10° to 30°.

Item 7. A hearing aid comprising a hearing aid housing with a receiver according to one or more of the preceding items, wherein the hearing aid housing comprises an outer surface and an internal cavity adapted for containing the receiver and where the hearing aid housing comprises a filter socket wherein the filter holder is releasably mounted, so that the filter holder provides a sound channel extending through the filter between the outer surface and the receiver housing.

Item 8. A hearing aid according to item 7, wherein the filter socket and the receiver are relatively sized in order to allow for insertion of the receiver housing through the channel and into the internal cavity, when the filter is dismantled from the filter socket.

Item 9. A hearing aid according to item 7 or 8, where the filter holder is permanently fastened to the receiver housing by gluing, soldering or welding.

Item 10. A hearing aid according to item 7 or 8, where the filter holder is releasably attached to the receiver housing with a press fit, a frictional fit, or by means of heat releasable glue.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents, as defined by the claims.

The invention claimed is:

1. A hearing aid, comprising:

a receiver; and a hearing aid housing with an internal cavity, wherein the internal cavity is configured to contain the receiver;

wherein the receiver comprises a receiver housing having a side face with a sound opening, and a filter holder with a filter, wherein the filter holder is fastened to the receiver housing;

wherein the filter holder has a bottom face, a first opening at the bottom face, a second opening configured for releasably mounting the filter to the filter holder, and a sound channel located between the first and second openings and aligned with the first opening;

wherein the bottom face of the filter holder abuts the side face of the receiver housing; and wherein the hearing aid housing further comprises an outer wall and a housing opening at the outer wall, and wherein the opening and the receiver are relatively sized to allow for insertion of the receiver housing through the housing opening into the internal cavity of the hearing aid housing, and wherein the internal cavity of the hearing aid housing is configured to contain the receiver housing while the filter holder is at the housing opening.

2. The hearing aid according to claim 1, where the bottom face is fastened to the side face of the receiver housing.

3. The hearing aid according to claim 1, where the filter holder is fastened to the receiver housing by gluing, soldering or welding.

4. The hearing aid according to claim 1, wherein the receiver housing has a cross section defined at least partially by first two sides that are parallel to each other and second two sides that are perpendicular to the first two sides;

wherein the filter holder has an outer surface conforming to the receiver housing and defining an outer opening; and wherein a largest cross sectional dimension of the receiver housing is smaller than the outer opening of the filter holder.

5. The hearing aid according to claim 1, wherein the filter holder defines a direction of detachment of the filter from the filter holder, the sound opening at the side face defines a primary direction of a sound emission that is perpendicular to the side face, and the direction of detachment is oblique with respect to the primary direction of the sound opening.

6. The hearing aid according to claim 5, wherein an angle between the direction of detachment and the primary direction of the sound emission is anywhere from 5° to 45°.

7. The hearing aid according to claim 1, wherein the filter holder is permanently fastened to the receiver housing by gluing, soldering or welding.

8. The hearing aid according to claim 1, wherein the filter holder is releasably attached to the receiver housing with a press fit, a frictional fit, or a heat releasable glue.

9. The hearing aid according to claim 1, wherein the filter comprises a cerumen filter.

10. The hearing aid according to claim 1, wherein the side face of the receiver housing is at an end of the receiver housing.

11. The hearing aid according to claim 1, wherein the filter holder has a portion configured to be placed circumferentially around an end of the receiver housing.

* * * * *